US009889977B2

(12) United States Patent
Piscopo

(10) Patent No.: US 9,889,977 B2
(45) Date of Patent: Feb. 13, 2018

(54) CHILD-RESISTANT CLOSURE

(71) Applicant: Plastek Industries, Inc., Erie, PA (US)

(72) Inventor: Peter A. Piscopo, Medford, NJ (US)

(73) Assignee: Plastek Industries, Inc., Erie, PA (US)

( * ) Notice: Subject to any disclaimer, the term of this patent is extended or adjusted under 35 U.S.C. 154(b) by 0 days.

(21) Appl. No.: 15/075,517

(22) Filed: Mar. 21, 2016

(65) Prior Publication Data

US 2016/0280429 A1 Sep. 29, 2016

Related U.S. Application Data

(60) Provisional application No. 62/136,861, filed on Mar. 23, 2015.

(51) Int. Cl.
*B65D 50/06* (2006.01)
*B65D 50/04* (2006.01)
*B65D 50/02* (2006.01)

(52) U.S. Cl.
CPC ..... *B65D 50/046* (2013.01)

(58) Field of Classification Search
CPC . B65D 41/0471; B65D 50/045; B65D 50/046
(Continued)

(56) References Cited

U.S. PATENT DOCUMENTS 4,752,013 A * 6/1988 Miller ..... B65D 41/3409 215/216
4,752,014 A * 6/1988 House ..... B65D 50/046 215/216

(Continued)

FOREIGN PATENT DOCUMENTS

EP 1357049 A2 10/2003
WO 97/16358 A1 5/1997

(Continued)

OTHER PUBLICATIONS

Applicant Admitted Prior Art: photos of generic atorvastatin containers, Mar. 18, 2015.

*Primary Examiner* — J. Gregory Pickett
*Assistant Examiner* — Niki M Eloshway
(74) *Attorney, Agent, or Firm* — Bachman & LaPointe, P.C.

(57) ABSTRACT

A child-resistant container has a container body having an externally threaded neck (36) and a first pair of engagement features. A cap closes the container body in a closed condition and is removable from the closed condition. The cap comprising the unitary combination of an inner sidewall and an outer sidewall. The inner sidewall has an internal thread for engaging the neck external thread. An outer sidewall for gripping by a user has first and second pairs. The second pair of segments are hinged to the inner sidewall for depressably flexing from relaxed condition to a flexed condition and bear a second pair of engagement features. In the installed condition of the cap and relaxed condition of the second pair of segments, the first pair of engagement features and second pair of engagement features are positioned to collide to block an unscrewing rotation of the cap. An upper web joins the inner sidewall and the outer sidewall first pair of segments. A pair of respective hinges between the second pair of segments and the inner sidewall merge with the inner sidewall at a location recessed from an upper end of the inner sidewall.

15 Claims, 6 Drawing Sheets

(58) Field of Classification Search
USPC ..... 215/216, 218, 221, 330, 217
See application file for complete search history.

(56) References Cited

U.S. PATENT DOCUMENTS

| | | | | |
|---|---|---|---|---|
| 5,449,077 | A * | 9/1995 | Seidler | B65D 50/045 215/206 |
| 5,603,421 | A * | 2/1997 | Opresco | B65D 50/046 215/217 |
| 5,671,853 | A | 9/1997 | Herr | |
| 5,836,466 | A * | 11/1998 | Briere | B65D 50/046 215/216 |
| 5,865,330 | A | 2/1999 | Buono | |
| 5,908,125 | A | 6/1999 | Opresco | |
| 5,915,576 | A | 6/1999 | Robinson | |
| 5,921,417 | A | 7/1999 | Mull | |
| 5,927,526 | A | 7/1999 | Herr | |
| 6,112,779 | A | 9/2000 | Camilla | |
| 6,112,921 | A | 9/2000 | Robinson | |
| 6,161,711 | A | 12/2000 | Miceli et al. | |
| 6,168,035 | B1 | 1/2001 | McLellan | |
| 6,296,130 | B1 | 10/2001 | Forsyth et al. | |
| 6,357,615 | B1 | 3/2002 | Herr | |
| 6,439,409 | B1 * | 8/2002 | Dressel | B65D 50/046 215/209 |
| 6,783,014 | B2 | 8/2004 | Luker | |
| 6,866,164 | B2 | 3/2005 | Branson et al. | |
| 6,988,642 | B2 | 1/2006 | Gallo et al. | |
| 7,097,058 | B2 | 8/2006 | Wellman et al. | |
| 7,111,746 | B2 | 9/2006 | Miceli et al. | |
| 7,334,694 | B2 | 2/2008 | Suffa | |
| 7,628,283 | B2 | 12/2009 | Shingle | |
| 7,628,298 | B2 | 12/2009 | Dewig et al. | |
| 7,641,064 | B2 | 1/2010 | Robinson | |
| 7,731,048 | B2 | 6/2010 | Alvares et al. | |
| 7,815,062 | B2 | 10/2010 | Suffa | |
| 7,828,166 | B1 | 11/2010 | Sprick | |
| 7,861,873 | B1 | 1/2011 | Bragg et al. | |
| 7,946,443 | B2 * | 5/2011 | Stull | B65D 41/0414 215/216 |
| 8,051,999 | B2 | 11/2011 | Carmody et al. | |
| 8,079,483 | B2 | 12/2011 | Brozell et al. | |
| 8,123,058 | B2 | 2/2012 | Brozell et al. | |
| 8,240,491 | B2 | 8/2012 | Beecroft et al. | |
| 8,245,867 | B2 | 8/2012 | Allen | |
| 8,292,101 | B1 | 10/2012 | Bragg et al. | |
| 8,371,463 | B2 | 2/2013 | Beecroft | |
| 8,870,004 | B2 * | 10/2014 | McCoy | B65D 1/02 206/807 |
| 2006/0213860 | A1 * | 9/2006 | Robinson | B65D 50/046 215/216 |
| 2010/0025355 | A1 * | 2/2010 | Beecroft | B65D 50/046 215/216 |
| 2011/0094990 | A1 * | 4/2011 | Sprishen | B65D 50/041 215/217 |
| 2012/0000879 | A1 | 1/2012 | McFarlane et al. | |

FOREIGN PATENT DOCUMENTS

| | | | |
|---|---|---|---|
| WO | 1998/050157 | A1 | 11/1998 |
| WO | 2000/006454 | A1 | 2/2000 |
| WO | 2004/103877 | A1 | 12/2004 |
| WO | 2006/044003 | A1 | 4/2006 |
| WO | 2008/141163 | A1 | 11/2008 |

* cited by examiner

CHILD-RESISTANT CLOSURE

CROSS-REFERENCE TO RELATED APPLICATION

Benefit is claimed of U.S. Patent Application No. 62/136,861, filed Mar. 23, 2015, and entitled "Child-Resistant Closure" the disclosure of which is incorporated by reference herein in its entirety as if set forth at length.

BACKGROUND OF THE INVENTION

The invention relates to screw-on container closures. More particularly, the invention relates to child-resistant closures.

Among numerous examples of child-resistant closures for small over-the-counter (OTC) medications (e.g., pills, capsules, tablets) is U.S. Pat. No. 5,671,853 of Herr, issued Sep. 30, 1997.

SUMMARY OF THE INVENTION

One aspect of the disclosure involves a child-resistant container having a container body having an externally threaded neck and a first pair of engagement features. A cap closes the container body in a closed condition and is removable from the closed condition. The cap comprising the unitary combination of an inner sidewall and an outer sidewall. The inner sidewall has an internal thread for engaging the neck external thread. An outer sidewall for gripping by a user has a first pair of segments and a second pair of segments. The second pair of segments are hinged to the inner sidewall for depressably flexing from relaxed condition to a flexed condition and bear a second pair of engagement features. In the installed condition of the cap and relaxed condition of the second pair of segments, the first pair of engagement features and second pair of engagement features are positioned to collide to block an unscrewing rotation of the cap. An upper web joins the inner sidewall and the outer sidewall first pair of segments. A pair of respective hinges between the second pair of segments and the inner sidewall merge with the inner sidewall at a location recessed from an upper end of the inner sidewall.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1A:
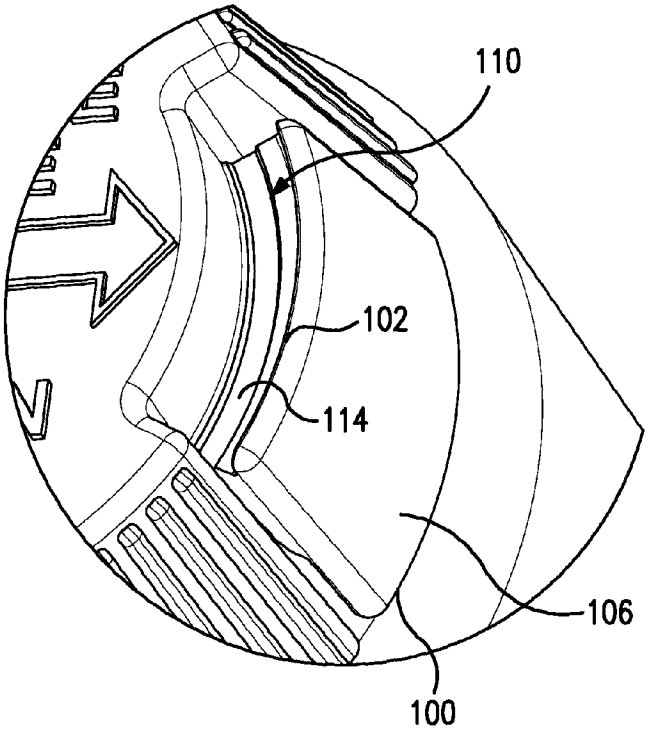
FIG. 1A is an enlarged view of a portion of the container of FIG. 1.
Figure 1:
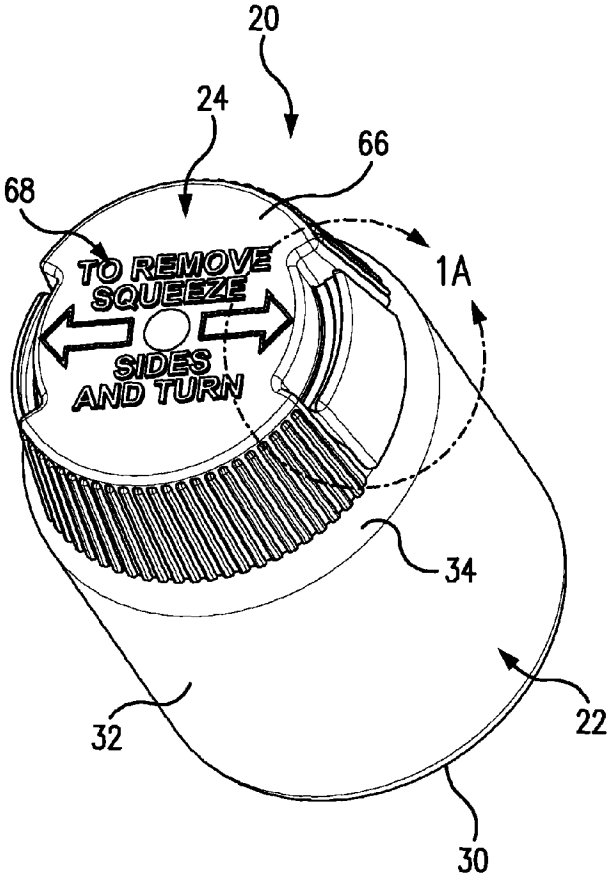
FIG. 1 is a top oblique view of a child-resistant container.
Figure 3:
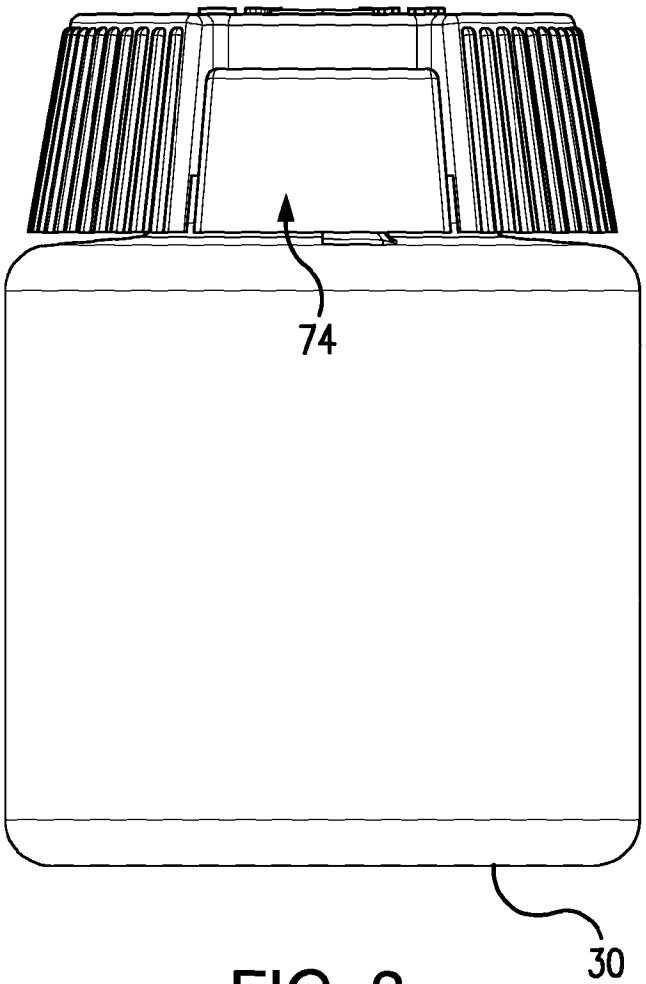
FIG. 3 is a side view of the container of FIG. 1 viewed orthogonal to FIG. 2.
Figure 2:
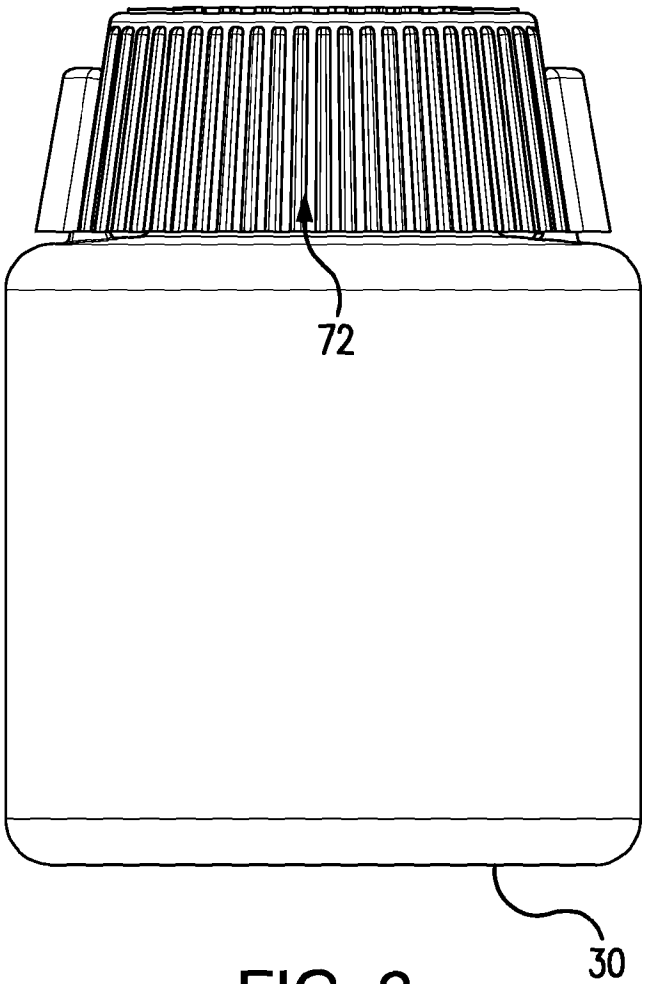
FIG. 2 is a front view of the container of FIG. 1.
Figure 4:
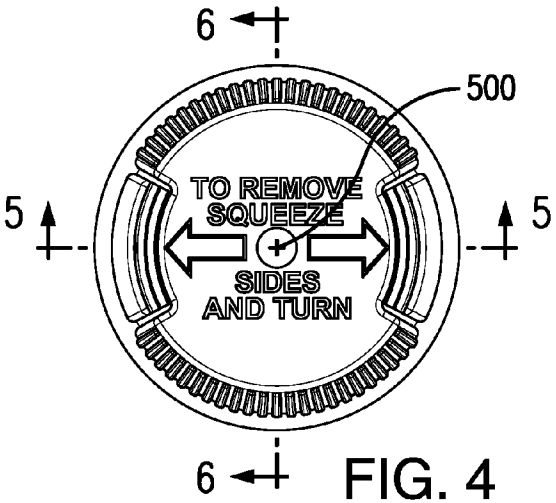
FIG. 4 is a top view of the container of FIG. 1.
Figure 6:
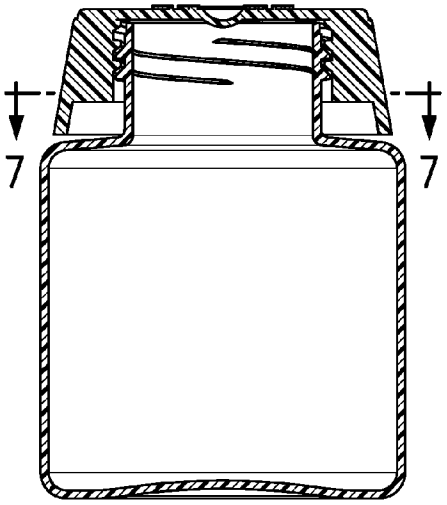
FIG. 6 is a central vertical sectional view of the container taken along line 6-6 of FIG. 4.
Figure 9:
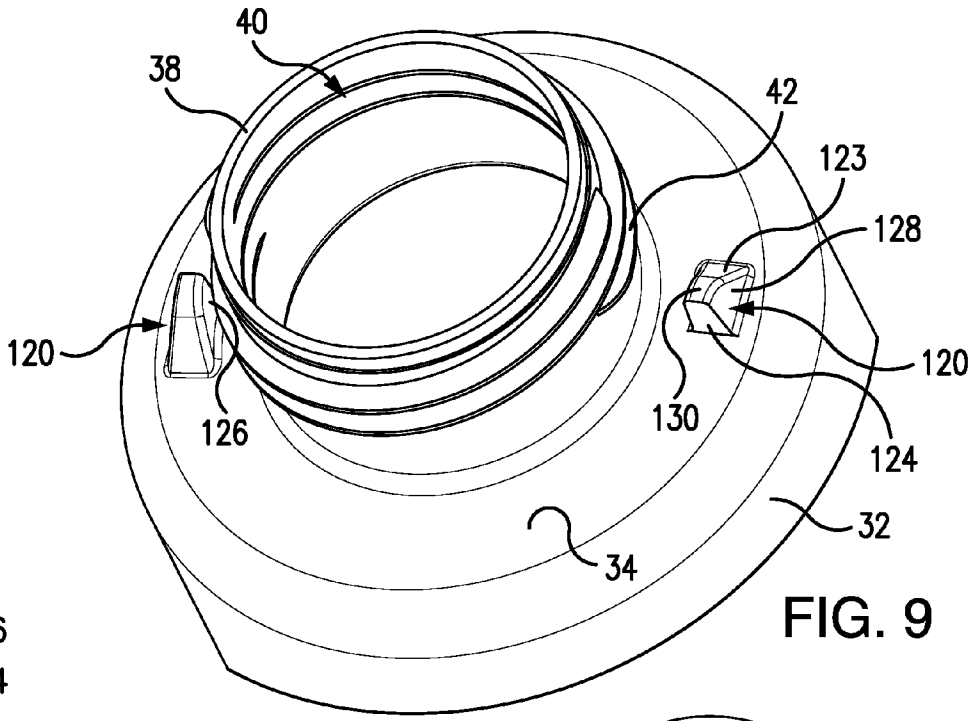
FIG. 9 is a cutaway top oblique view of a body of the container of FIG. 1.
Figure 12:
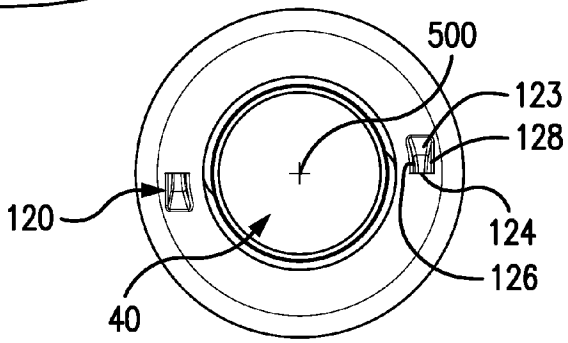
FIG. 12 is a top view of the body of FIG. 9.
Figure 11:
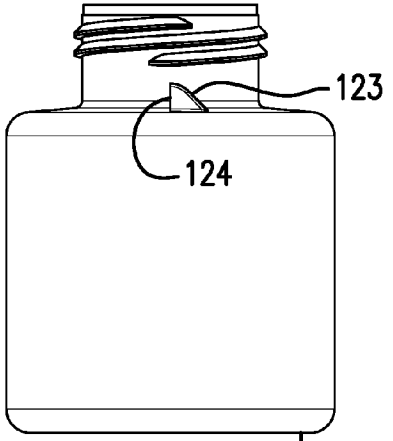
FIG. 11 is a side view of the body of FIG. 9.
Figure 10:
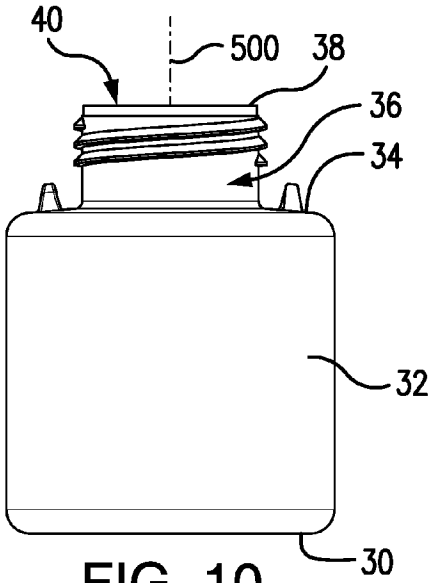
FIG. 10 is a front view of the body of FIG. 9.

FIG. 1 shows a container 20 comprising a container body 22 and a closure 24. The exemplary container body is a molded plastic single-piece member (e.g., roto-molded or blow molded or injection molded). The exemplary body has a base 30, a sidewall 32 extending upward from the base, a shoulder 34 extending upward from the sidewall, and a neck 36 (FIG. 10) extending upward from the shoulder and extending to a rim 38 to define a body opening or mouth 40 (FIG. 9). The neck bears an external thread 42 for engaging an internal thread of the closure. The neck defines a central longitudinal/vertical axis 500. The exemplary thread is a double lead thread. The double lead facilitates straight engagement and disengagement.

The exemplary closure 24 is a one-piece closure. An exemplary closure piece is molded plastic (e.g., injection molded). Exemplary plastics are polyolefins such as polypropylenes and polyethylenes. The closure may comprise an additional member such as an elastomeric or paper seal or gasket, safety seal, or the like.

Figure 5:
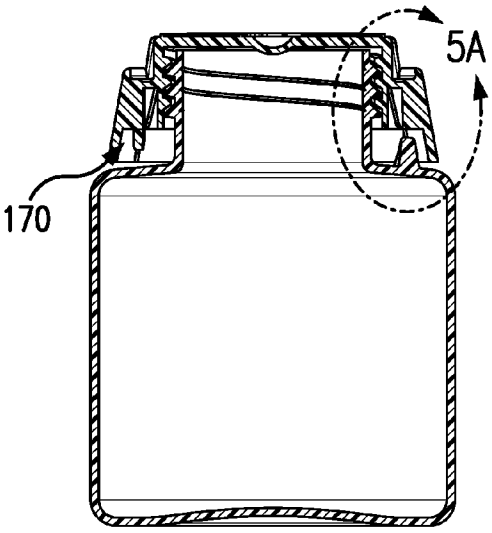
FIG. 5 is a central vertical sectional view of the container taken along line 5-5 of FIG. 4.
Figure 5A:
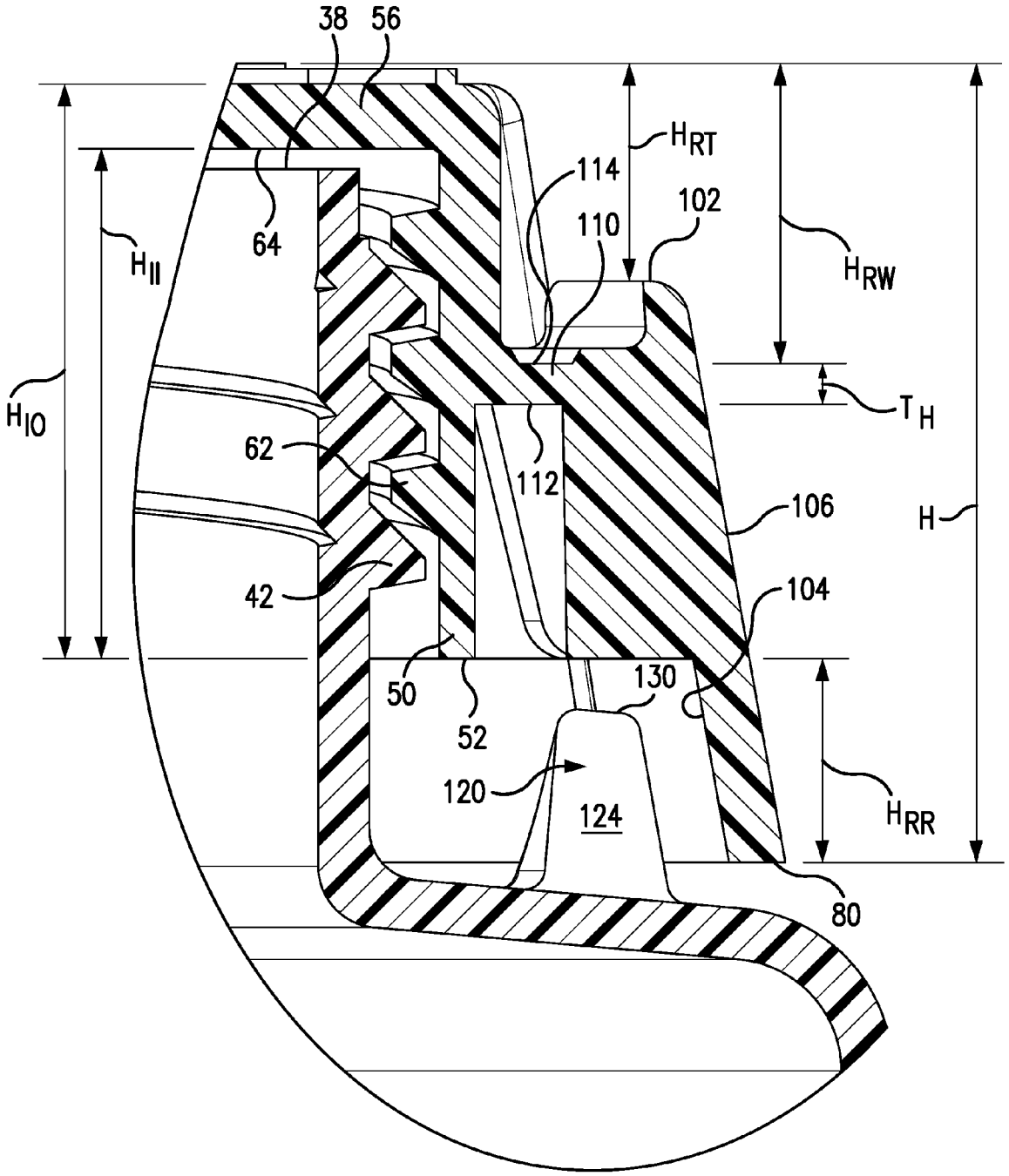
FIG. 5A is an enlarged view of a portion of the container of FIG. 5.
Figure 8:
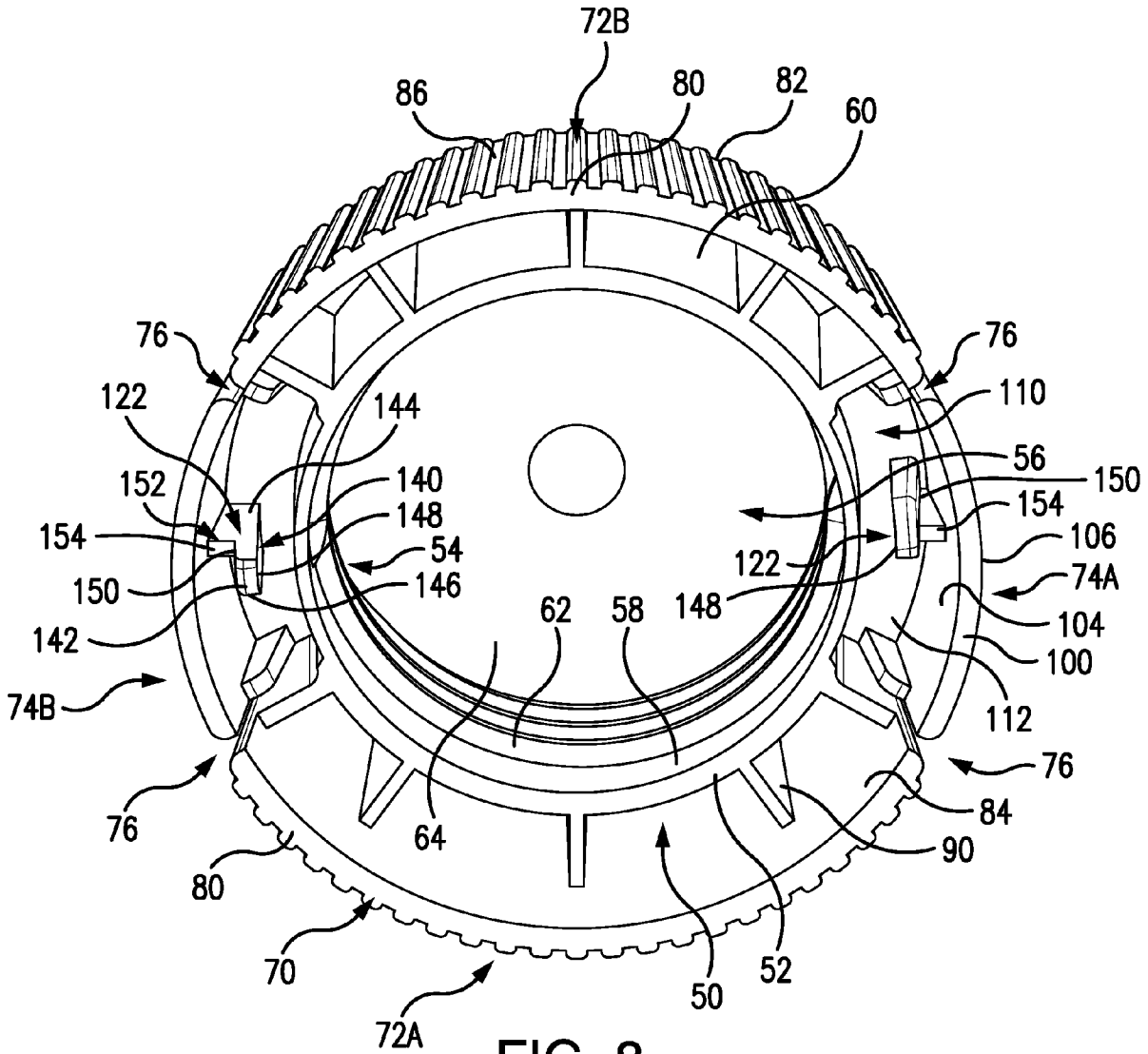
FIG. 8 is a bottom oblique view of a closure of the container.

FIG. 8 shows the exemplary closure as comprising an inner sidewall 50 extending upward from a lower end formed by a rim 52 to an upper end 54 merging with a transverse web 56 closing the upper end. The inner sidewall 50 has an inboard or inner diameter (ID) surface 58 and an outboard or outer diameter (OD) surface 60. The ID surface 58 bears an internal thread 62 complementary to the external thread of the neck. In the fully installed condition, the underside of the web 56 inboard of the ID surface 58 may seal against the rim 38 or be in close facing proximity thereto (FIG. 5A). FIG. 8 shows an underside 64 of the web and FIG. 1 shows an upper surface 66 of the web. The upper surface may have, pre-molded thereto, instructional indicia 68.

The closure further comprises an outer sidewall 70 (FIG. 8). As is discussed further below, the outer sidewall 70 is segmented into an exemplary four portions with a first pair of opposed portions being intact gripping portions 72A, 72B (collectively or individually 72) and a second pair of portions being release tabs 74A, 74B (collectively or individually 74; orthogonal to the first pair). The portions 72 are gripping portions for gripping by the user to rotate the closure. Vertical gaps 76 separate adjacent circumferential edges/ends of the gripping portions and release tabs.

The gripping portions 72 extend from a lower rim 80 to an upper end 82. The upper end 82 merges with a periphery of the web 56. The gripping portions 72 each have an inboard or inner diameter (ID) surface 84 and an outboard or outer diameter (OD) surface 86. The exemplary surface 86 bears a series of lands and grooves or other contouring to facilitate gripping. Between the outer sidewall ID surface 84 and the inner sidewall OD surface 60, a plurality of radial webs 90 join the inner sidewall to the outer sidewall for structural integrity.

The release tabs 74 also extend from a lower rim 100 to an upper end 102 (FIG. 1A). The release tabs 74 each have an inboard or inner diameter (ID) surface 104 and an outboard or outer diameter (OD) surface 106. The exemplary release tabs 74 are each connected by a respective associated web 110 to the inner sidewall 50. As is discussed below, the web 110 forms a hinge. The web 110 has a lower surface or underside 112 and an upper surface 114. FIG. 5A shows the web 110 vertically recessed along the inner sidewall well below the web 56. A recessing height may be measured as one or more of a height between the surfaces 64 and 112 or between the upper surfaces or between horizontal medians of the webs 56 and 110. This recessing may represent an exemplary at least 20% of an overall height H of the closure (more narrowly at least 25% or at least 30%; exemplary upper limits if desired may be 40% or 50% or 60% or in a range any pair of those upper and lower limits) The recessing may be measured as a height $H_{RW}$ from a lowest point on the upper surface 114 to highest point on the web (even if measured to the peaks of molded indicia). Said overall height may be may be from the same point on the web down to the lowest point on the rim 80.

Additionally or alternatively, recessing may be measured relative to inner sidewall height. FIG. 5A shows the inner sidewall lower rim vertically recessed by a height $H_{RR}$ relative to the outer sidewall lower rim. Exemplary rim recessing conserves plastic in the molding process. This recessing leads to departures between the two alternative measurements. With recessing of rims, exemplary recessing of the hinge is at least 20% of the inner sidewall height (more narrowly at least 30% or at least 40%; exemplary upper limits if desired may be 60% or 70% or 80% or the recessing may be in a range of pairs of such upper and lower limits). Said inner sidewall overall height may be an inner overall height $H_{II}$ or an outer overall height $H_{IO}$.

The exemplary upper ends 102 are also recessed (e.g., by a height $H_{RT}$). This recessing both conserves material and helps locate the user's fingers downward from the webs 110 to provide leverage. Exemplary $H_{RT}$ is at least 10% or at least 20% or at least 25%; exemplary upper limits if desired are 30% or 40% or the recessing may be in a range of pairs of such upper and lower limits.

As is discussed further below, the body and closure have two pairs of engagement features 120 (FIG. 9), 122 (FIG. 8) cooperating with each other. The engagement features allow the closure to be rotated about the axis 500 in a direction to install the closure (i.e., screw the closure onto the body). The engagement features may be manipulated to allow the closure to be rotated in an opposite unscrewing/removal rotation. The manipulation involves inwardly compressing lower portions of the release tabs 74. This manipulation may require application of sufficient force/pressure or manipulation to qualify as a child-resistant action. Absent the manipulation, unscrewing rotation is blocked by the engagement features.

The exemplary engagement features 120 (FIG. 9) are formed by a pair of ramps extending longitudinally upward from the shoulder 34 diametrically opposite each other. The ramps have a first circumferential surface or face 123 and opposite second circumferential surface or face 124. These are joined by an inboard face 126 and an outboard face 128. The surfaces 123 and 124 may also meet at an apex region 130.

As is discussed further below, the surfaces 123 are ramp surfaces and the surfaces 124 are stop surfaces. The surfaces 124 are relatively longitudinal so as to cooperate with complementary surfaces of the closure engagement features 122 to resist unscrewing motion absent the aforementioned manipulation. The surfaces 123 allow the closure engagement features to override in a screwing/installing rotation as is discussed further below.

FIG. 8 shows further details of the features 122. The exemplary features 122 comprise an inner wall 140 depending from the underside 112 of the web 110 and extending downward to a lower end 142. The inner wall has a first circumferential end 144 and a second circumferential end 146, an inboard or inner diameter (ID) surface 148, and an outboard or outer diameter (OD) surface 150. For structural integrity, the walls 140 are joined to the associated release tabs by a vertical web 152 having a lower extremity/end 154 upwardly recessed relative to the lower end 142. Thus, the wall 140, release tab, and web 152 form a downwardly open channel 170 or gap (FIG. 5).

Figure 7:
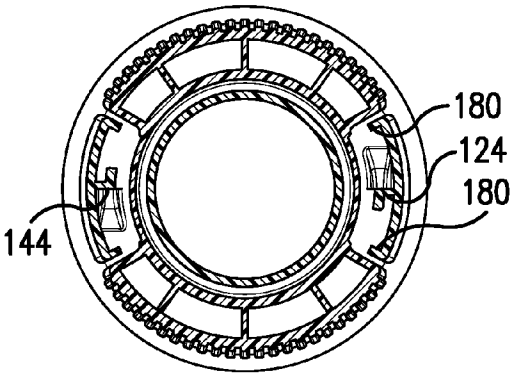
FIG. 7 is a downward transverse sectional view of a container taken along line 7-7 of FIG. 5.

FIG. 7 shows an installed or screwed-on condition wherein the ends or surfaces 144 along a protruding lower portion of the wall (forming an inboard wall of the channel 170) are in abutting engagement with the surfaces 124 to prevent/block an unscrewing rotation of the closure about the axis 500.

However, lower portions of the OD surfaces 106 of the tabs may be squeezed inward flexing the web/hinge 100 and bringing the channels 170 into radial registry with the features 120. In this condition, while maintaining compression between the release tabs, the closure may be unscrewed via an unscrewing rotation about the axis 500 with the each of the features 120 passing circumferentially through the adjacent channel 170. FIG. 7 also shows encasement ribs 180 along lateral ends/edges of the tabs 74. These ribs provide enhanced strength to the tabs to focus/concentrate deformation at the hinges In an installing rotation, one need not squeeze the release tabs. Instead, the ends 146 (or a rounded transition between them and the lower ends 142) will engage the ramping surface 123 (and/or a curving transition to the apex region 130). The angling of the meeting surfaces is sufficient to flex the closure (e.g., radially outwardly flex the release tabs) to permit an overriding return to the installed condition.

One or more embodiments of the present invention have been described. Nevertheless, it will be understood that various modifications may be made without departing from the spirit and scope of the invention. For example, desirability of reusing existing molding and/or capping equipment may influence particular implementations. Accordingly, other embodiments are within the scope of the following claims.

What is claimed is:

1. A child-resistant container (201) comprising:

a container body (22) having:

an externally threaded neck (36); and a first pair of engagement features (120); and a cap (24) for closing the container body in a closed condition and removable from the closed condition, the cap comprising the unitary combination of:

an inner sidewall (50) having an internal thread (62) for engaging the neck external thread;

an outer sidewall (70) for gripping by a user and comprising:

a first pair of segments (72A, 72B);

a second pair of segments (74A, 74B):

hinged to the inner sidewall for depressably flexing from relaxed condition to a flexed condition by depressing a lower portion of an outer surface (106); and bearing a second pair of engagement features (122), in the installed condition of the cap and relaxed condition of the second pair of segments, the first pair of engagement features and second pair of engagement features positioned to collide to block an unscrewing rotation of the cap; and an upper web (56) joining the inner sidewall and the outer sidewall first pair of segments, wherein:

a pair of respective hinges (110) between the second pair of segments and the inner sidewall merge with the inner sidewall at a location:

recessed from an upper end of the inner sidewall by 20% to 80% of a height of the inner sidewall; and above the lower portion of the outer surface.

2. The child-resistant container of claim 1 wherein:

the hinges are recessed by at least 30% of the height of the inner sidewall.

3. The child-resistant container of claim 1 wherein:

the hinges are recessed by at least 30% of a height of the closure.

4. The child-resistant container of claim 1 wherein:

upper ends of the second pair of segments are recessed by at least 20% of a height of the closure.

5. The child-resistant container of claim 1 wherein:

a lower rim of the inner sidewall is recessed relative to a lower rim of the outer sidewall.

6. The child-resistant container of claim 1 wherein:

combination is unitarily molded of a plastic.

7. The child-resistant container of claim 1 wherein:

the first engagement feature comprises one or more gaps (170) in a radially inwardly projecting feature of the outer member sidewall.

8. A method for using the container of claim 1, the method comprising:

inwardly depressing the second pair of segments; and rotating the cap while holding the second pair of segments depressed so that the second pair of engagement features pass by the first pair of engagement features.

9. The method of claim 8 further comprising:

further rotating the cap to allow removal of the cap.

10. The method of claim 8 wherein:

the inwardly depressing is below the hinges.

11. A method for assembling the container of claim 1, the method comprising:

rotating the cap in a threading direction, the rotating causing a camming engagement between the first pair of engagement features and the second pair of engagement features to outwardly flex the second pair of engagement features.

12. The child-resistant container of claim 1 wherein:

the hinges are recessed by 20% to 70% of the height of the inner sidewall.

13. The child-resistant container of claim 1 wherein:

the hinges are recessed by 20% to 60% of the height of the inner sidewall.

14. The child-resistant container of claim 1 wherein:

the hinges are recessed by 30% to 70% of the height of the inner sidewall.

15. The child-resistant container of claim 1 wherein:

the hinges are recessed by 30% to 60% of the height of the inner sidewall.

* * * * *